US009598960B2

(12) United States Patent
Rood et al.

(10) Patent No.: US 9,598,960 B2
(45) Date of Patent: Mar. 21, 2017

(54) DOUBLE-ENDED SCROLL COMPRESSOR LUBRICATION OF ONE ORBITING SCROLL BEARING VIA CRANKSHAFT OIL GALLERY FROM ANOTHER ORBITING SCROLL BEARING

(71) Applicant: TRANE INTERNATIONAL INC., Piscataway, NJ (US)

(72) Inventors: Jerry Allen Rood, Onalaska, WI (US); Scott Joseph Smerud, La Crosse, WI (US); Keith Adam Novak, Holmen, WI (US); Joseph M. Heger, West Salem, WI (US); Derrick Lepak, La Crosse, WI (US); Michael Gerard Benco, Onalaska, WI (US)

(73) Assignee: TRANE INTERNATIONAL INC., Piscataway, NJ (US)

( * ) Notice: Subject to any disclaimer, the term of this patent is extended or adjusted under 35 U.S.C. 154(b) by 162 days.

(21) Appl. No.: 14/448,132

(22) Filed: Jul. 31, 2014

(65) Prior Publication Data

US 2015/0037184 A1 Feb. 5, 2015

Related U.S. Application Data

(60) Provisional application No. 61/860,338, filed on Jul. 31, 2013.

(51) Int. Cl.
*F03C 2/00* (2006.01)
*F03C 4/00* (2006.01)
(Continued)

(52) U.S. Cl.
CPC ..... *F01C 21/02* (2013.01); *F01C 1/0215* (2013.01); *F04C 18/0215* (2013.01); *F04C 23/001* (2013.01); *F04C 29/0057* (2013.01); *F04C 29/021* (2013.01); *F04C 29/023* (2013.01); *F04C 23/008* (2013.01); *F04C 2240/51* (2013.01); *F04C 2240/56* (2013.01)

(58) Field of Classification Search
CPC .. F04C 18/0215; F04C 23/001; F04C 23/008; F04C 29/025; F04C 29/023; F04C 29/021; F04C 2240/56; F04C 2240/51; F04C 29/0057; F01C 1/0215; F01C 21/02
USPC ..... 418/5, 15, 55.1–55.6, 57, 58, 60, 88, 94; 417/410.5; 184/6.16–6.17
See application file for complete search history.

(56) References Cited

U.S. PATENT DOCUMENTS 4,553,913 A * 11/1985 Morishita ..... F04C 18/0215 418/55.5
4,993,929 A * 2/1991 Weatherston ..... F04C 18/0215 418/55.6
(Continued)

*Primary Examiner* — Theresa Trieu
(74) *Attorney, Agent, or Firm* — Hamre, Schumann, Mueller & Larson, P.C.

(57) ABSTRACT

A scroll compressor orbiting scroll bearing lubrication system includes a scroll compressor crankshaft having a lubricating fluid gallery extending therethrough between a first stage orbiting scroll and a second stage orbiting scroll. The first stage employs an orbiting scroll radial bearing and an orbiting scroll hydrodynamic thrust bearing, while the second stage employs an orbiting scroll radial bearing and an orbiting scroll hydrostatic thrust bearing. Lubricating fluid is supplied to the second stage orbiting scroll radial bearing via the lubricating fluid gallery.

20 Claims, 4 Drawing Sheets

(51) Int. Cl.

| | |
|---|---|
| ***F04C 2/00*** | (2006.01) |
| ***F04C 18/00*** | (2006.01) |
| ***F01C 21/02*** | (2006.01) |
| ***F04C 18/02*** | (2006.01) |
| ***F04C 29/00*** | (2006.01) |
| ***F04C 29/02*** | (2006.01) |
| ***F01C 1/02*** | (2006.01) |
| *F04C 23/00* | (2006.01) |

(56) References Cited

U.S. PATENT DOCUMENTS

| | | | | |
|---|---|---|---|---|
| 4,997,350 | A * | 3/1991 | Tamura | F04C 18/0215 418/55.6 |
| 5,345,785 | A | 9/1994 | Sekigami et al. | |
| 5,931,650 | A | 8/1999 | Yasu et al. | |
| 6,059,540 | A * | 5/2000 | Ni | F04C 18/0215 418/55.6 |
| 6,071,100 | A | 6/2000 | Yamada et al. | |
| 6,116,877 | A | 9/2000 | Takeuchi et al. | |
| 6,139,295 | A | 10/2000 | Utter et al. | |
| 6,227,828 | B1 | 5/2001 | Takeuchi et al. | |
| 6,264,446 | B1 | 7/2001 | Rajendran et al. | |
| 6,267,572 | B1 * | 7/2001 | Suefuji | F04C 23/001 418/60 |
| 6,287,099 | B1 | 9/2001 | Chang, II et al. | |
| 7,007,505 | B2 | 3/2006 | Tsuboe et al. | |
| 7,021,912 | B2 | 4/2006 | Tsuchiya et al. | |
| 7,186,099 | B2 | 3/2007 | Elson et al. | |
| 7,201,567 | B2 * | 4/2007 | Wiertz | F04C 23/001 418/60 |
| 8,419,394 | B2 | 4/2013 | Cho et al. | |
| 8,506,272 | B2 | 8/2013 | Fan et al. | |
| 2010/0122549 | A1 | 5/2010 | Cho et al. | |
| 2011/0085925 | A1 | 4/2011 | Fan et al. | |

* cited by examiner

DOUBLE-ENDED SCROLL COMPRESSOR LUBRICATION OF ONE ORBITING SCROLL BEARING VIA CRANKSHAFT OIL GALLERY FROM ANOTHER ORBITING SCROLL BEARING

FIELD

The embodiments described herein relate generally to orbiting scroll bearing lubrication. More particularly, the embodiments described herein relate to a lubrication system that provides high pressure lubrication to orbiting scroll radial bearings for example in a compressor with multiple compressions, such as for example a double-ended scroll compressor having two orbiting scroll radial bearings, which may be arranged as a multi-stage, e.g. serial-stage, scroll compressor.

BACKGROUND

One increasingly popular type of compressor is a scroll compressor. In a scroll compressor, a pair of scroll members orbits relative to each other to compress an entrapped refrigerant.

In typical scroll compressors, a first, stationary, scroll member has a base and a generally spiral wrap extending from its base. A second, orbiting, scroll member has a base and a generally spiral wrap extending from its base. The second, orbiting, scroll member is driven to orbit by a rotating shaft. Some scroll compressors employ an eccentric pin on the rotating shaft that extends into a slider block which is received within a boss on a rear face of the second, orbiting, scroll member.

SUMMARY

In a scroll compressor designed to be either a two-stage machine or a parallel-flow machine, two orbiting scroll radial bearings must be supplied with oil. When these bearings are journal bearings, for example, they may require high oil flow rates. Oil could be supplied to both radial bearings by an oil pump attached to the compressor's crankshaft, but the work required to pump the oil can disadvantageously become an added power loss in the compressor.

When orbiting scroll thrust bearings are of a conventional hydrodynamic type, for example, oil may be supplied by pressure differences from an oil sump at high pressure to the orbiting scroll radial and thrust bearings which are in a relatively low-pressure part of the scroll compressor.

Hydrostatic (balanced piston) type orbiting scroll thrust bearings, however, are typically not lubricated in the same manner as conventional hydrodynamic type orbiting scroll thrust bearings. One reason for this is that hydrodynamic bearings may need low oil supply pressures and high oil flow rates (e.g. oil feed pressures above the suction pressure e.g., about 30 psid or about no more than about 70 psid relative to the suction pressure), but hydrostatic bearings are frequently designed for high oil supply pressures and low oil flow rates. High oil feed pressures force extra oil through the compressor journal bearings, which may disadvantageously decrease compressor efficiency.

For example, the second stage orbiting scroll thrust bearing of a two-stage scroll compressor however may require a hydrostatic bearing design with an oil supply pressure that is at times very high (e.g. about 200 psid) relative to the suction or economizer pressure (e.g., about no more than about 70 psid) in order to maintain the kinematic stability of the orbiting scroll or otherwise offset the axial forces due to compression.

It will be appreciated, however, that the orbiting scroll radial bearing lubrication described herein may be applied where it may be somewhat difficult to supply oil to both orbiting radial scroll bearings (e.g. in a two-stage scroll compressor), irrespective of the type of thrust bearing being used. The orbiting scroll bearing lubrication described herein can be particularly useful where one of the thrust bearings is a hydrostatic bearing and/or an oil pump is not present. Conventional hydrodynamic type orbiting scroll radial bearings may be lubricated via oil passages in the orbiting scroll baseplate.

In view of the foregoing, there is a need to provide methods and mechanisms for lubricating an orbiting scroll radial bearing of a multi-stage or parallel-flow scroll compressor in a manner that does not adversely affect compressor efficiency.

According to one embodiment, a scroll compressor comprises a crankshaft, a first stage orbiting scroll member driven to orbit via a first eccentric drive pin rotatably journaled in a respective orbiting scroll radial bearing and a second stage orbiting scroll member driven to orbit via a second eccentric drive pin rotatably journaled in a respective orbiting scroll radial bearing. The second stage further comprises a hydrostatic (balanced piston) type orbiting scroll thrust bearing. Each orbiting scroll member comprises a respective base and a generally spiral wrap extending from its respective base. The first eccentric drive pin extends from one end of the crankshaft while the second eccentric drive pin extends from the opposite end of the crankshaft. The first orbiting scroll member base comprises a plurality of lubricating fluid ports configured to receive a lubricating fluid via a high pressure sump and to deliver a portion of the received lubricating fluid to its respective orbiting scroll radial bearing. The plurality of lubricating fluid ports are further configured to deliver a portion of the received lubricating fluid to the second stage orbiting scroll radial bearing via a lubricating fluid/oil gallery extending axially through the crankshaft between the first stage orbiting scroll and the second stage orbiting scroll.

According to another embodiment, a scroll compressor orbiting scroll bearing lubrication system comprises a lubricating fluid sump storing a lubricating fluid pressurized substantially higher than the scroll compressor suction pressure. The lubrication system further comprises a compressor crankshaft comprising a first eccentric drive pin extending from a first end of the crankshaft, wherein the first drive pin is rotatably disposed at least partially within a first radial orbital bearing configured to engage a first orbiting scroll comprising a baseplate and a spiral wrap element extending from the baseplate, and further comprising lubricating fluid passages, e.g. oil passages in the baseplate. The lubrication system further comprises a second eccentric drive pin extending from a second end of the crankshaft, wherein the second drive pin is rotatably disposed at least partially within a second radial orbital bearing configured to engage a second orbiting scroll. The lubrication system further comprises an orbiting scroll hydrodynamic thrust bearing associated with the first orbiting scroll, wherein the first radial orbital bearing is configured to receive lubricating fluid from the lubricating fluid sump via the oil passages in the first orbiting scroll baseplate; and an orbiting scroll hydrostatic thrust bearing associated with the second orbiting scroll. The compressor crankshaft further comprises a lubricating fluid gallery extending axially through the crankshaft between the first orbiting scroll and the second orbiting scroll such that lubricating fluid is supplied to the second radial orbital bearing via the oil passages in the first orbiting scroll baseplate and the lubricating fluid gallery. In some embodiments the source of lubricating fluid may be the lubricating fluid sump.

According to yet another embodiment, a scroll compressor orbiting scroll bearing lubrication system comprises a scroll compressor crankshaft comprising a lubricating fluid gallery extending therethrough, a first stage orbiting scroll driven via a first end of the scroll compressor crankshaft rotatably disposed at least partially within a first orbiting scroll radial bearing, a second stage orbiting scroll driven via a second end of the scroll compressor crankshaft rotatably disposed at least partially within a second orbiting scroll radial bearing, an orbiting scroll hydrodynamic thrust bearing associated with the first stage orbiting scroll, and an orbiting scroll hydrostatic thrust bearing associated with the second stage orbiting scroll. The lubricating fluid is supplied to the second orbiting scroll radial bearing via the lubricating fluid gallery.

According to still another embodiment, a scroll compressor orbiting scroll bearing lubrication system comprises a scroll compressor crankshaft comprising a lubricating fluid gallery extending therethrough between a first stage orbiting scroll and a second stage orbiting scroll, a first stage orbiting scroll radial bearing, a first stage orbiting scroll hydrodynamic thrust bearing, a second stage orbiting scroll radial bearing, and a second stage orbiting scroll hydrostatic thrust bearing. Lubricating fluid is supplied to the second stage orbiting scroll radial bearing via the lubricating fluid gallery.

While two-stage compressors are described, it will be appreciated that the orbiting scroll radial bearing lubrication systems and methods can be suitably applied to any double-ended scroll compressor, which may or may be a two-stage compressor, and where for example there is a need to provide radial bearing lubrication at both ends of the scroll compressor.

DRAWINGS

These and other features, aspects, and advantages of the lubrication methods and systems will become better understood when the following detailed description is read with reference to the accompanying drawing, wherein.

While the above-identified drawing figures set forth particular embodiments of the lubrication methods and systems, other embodiments are also contemplated, as noted in the discussion. In all cases, this disclosure presents illustrated embodiments of the lubrication methods and systems by way of representation and not limitation. Numerous other modifications and embodiments can be devised by those skilled in the art which fall within the scope and spirit of the principles of the lubrication methods and systems described herein.

DETAILED DESCRIPTION

Figure 1:
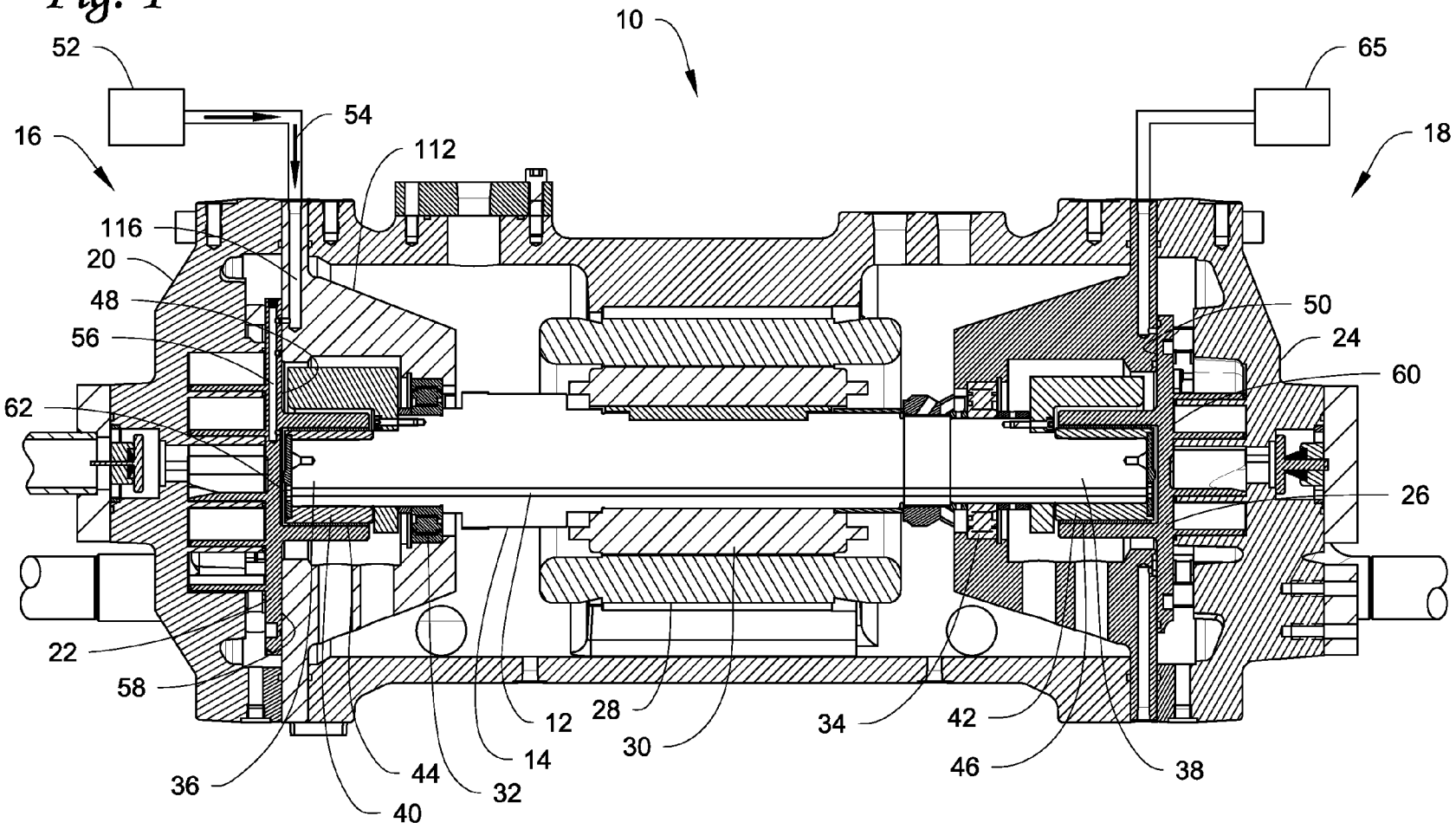
FIG. 1 is a cross-sectional side view of a two-stage scroll compressor having an axial lubricating fluid gallery extending through its crankshaft, according to one embodiment.

FIG. 1 is a cross-sectional side view of a two-stage scroll compressor 10 having an axial lubricating fluid gallery 12 extending through its crankshaft 14, according to one embodiment. Although particular embodiments are described herein with respect to two-stage scroll compressors, it will be appreciated the principles described herein are not so limited, and may just as easily be applied to other types of compressors, such as, without limitation, double-ended scroll compressors, other multi-stage compressors, such as for example serial, parallel, or other compressors with more than one compression that may not be in serial flow, and reciprocating compressors.

Looking again at FIG. 1, the two-stage horizontal scroll compressor 10 is illustrated in cross-sectional side view, as stated herein. Although the embodiments are described herein with reference to horizontal scroll compressors, the principles described herein may just as easily be applied to non-horizontal scroll compressors. Further, it will be appreciated that the principles described herein may be applied to single stage and multi-stage compressors, and also including but not limited to parallel flow compressors.

Scroll compressor 10 comprises a first, input stage 16 and a second, output stage 18. The first, input stage 16 comprises a fixed, non-orbiting scroll member 20 and an orbiting scroll member 22. Non-orbiting scroll member 20 is positioned in meshing engagement with orbiting scroll member 22.

The second, output stage 18 comprises a fixed, non-orbiting scroll member 24 and an orbiting scroll member 26. Non-orbiting scroll member 24 is positioned in meshing engagement with orbiting scroll member 26.

Scroll compressor 10 further comprises a compressor drive shaft or crankshaft 14 extending between the first, input stage 16 and the second, output stage 18. The crankshaft 14 may be rotatably driven via an electric motor comprising windings 28 and a rotor 30 press-fit on the compressor crankshaft 14. The crankshaft 14 may be rotatably disposed or journaled within one or more main bearings 32, 34. Each crankshaft main bearing 32, 34 may comprise a rolling element bearing having a generally cylindrical portion.

The compressor crankshaft 14 further may comprise a first eccentric drive pin 36 disposed at its first, input stage end. The compressor crankshaft 14 may further comprise a second eccentric drive pin 38 disposed at its second, output stage end. Each eccentric drive pin 36, 38 may be disposed within a pressed-on eccentric pin sleeve 40, 42 that is placed over a respective eccentric drive pin 36, 38. The scroll compressor 10 may then operate to provide an orbiting motion of one of two intermeshing scrolls 20, 22 and/or 24, 26 via a radial orbital bearing 44, 46 that is placed over its respective eccentric pin sleeve 40, 42.

According to one embodiment, the first stage 16 further comprises a conventional hydrodynamic type orbiting scroll thrust bearing 48. The second stage of compression 18 further comprises a hydrostatic type orbiting scroll thrust bearing 50. A high pressure oil sump 52 may use differential pressures to supply lubricating fluid/oil 54 to the first stage radial orbital bearing 44 and the orbiting scroll thrust bearing 48. The lubricating fluid/oil 54 may flow through oil passages, e.g. 56, formed in the orbiting scroll baseplate 58. The oil passage(s) are further described below with respect to FIGS. 2A, 2B, and 3.

The second stage radial orbital bearing 46 however is often not supplied with lubricating fluid in a similar fashion using oil passages formed in its respective orbiting scroll baseplate 60 since the second stage orbiting scroll thrust bearing 50 may be at much higher pressures (e.g., about 200 psid) in order to maintain the kinematic stability of the orbiting scroll 26 or to offset the axial forces due to compression. The foregoing higher pressure(s) may unwantonly push extra oil through the orbiting scroll radial bearing 46, disadvantageously decreasing scroll compressor 10 efficiency.

With continued reference to FIG. 1, an axial gallery 12 passes through the crankshaft 14 between the first stage radial bearing 44 and the second stage radial bearing 46. The high pressure oil sump 52 may then use differential pressures to supply the first stage orbiting scroll radial bearing 44 and respective hydrodynamic type thrust bearing 48 as well as the second stage orbiting scroll radial bearing 46, while in some embodiments, a second supply line 65 delivers oil to the second stage hydrostatic type thrust bearing 50. More specifically, the lubricating fluid/oil 54 supplied via the high pressure oil sump 52 passes through, for example the oil passages 56, the feed cavity 62, and subsequently through the axial gallery 12 to the second stage orbiting scroll radial bearing 46. It will be appreciated that the gallery 12 may or may not be canted relative to the crankshaft axis of rotation since a canted gallery 12 may in some applications be useful to encourage oil flow toward the second or subsequent stage orbiting scroll thrust and/or radial bearing(s).

With further reference to supply line 65, in some embodiments the supply line 65 is an oil passage to supply lubricating fluid to the orbiting scroll hydrostatic thrust bearing 50 associated with the second stage orbiting scroll 18. In some embodiments, the pressure supplied through this passage is at a different pressure than a pressure of the lubricating fluid supplied to one or more of the first orbiting scroll thrust bearing, the first orbiting scroll radial bearing, and the second orbiting scroll radial bearing. For example, the pressure is at higher suction pressures, e.g. at about 200 psid which is significantly higher than pressures (e.g. at about 30 psid or at about no higher than about 70 psid) that may be needed for the radial bearings (e.g. 44, 46) and a hydrodynamic thrust bearing (e.g. 48) which may be employed in the first stage scroll 16.

In summary explanation, embodiments have been described herein for supplying lubricating oil/fluid 54 to a second or subsequent stage radial orbital bearing 46 of a multi-stage scroll compressor 10 when the second or subsequent stage 18 employs an orbiting scroll hydrostatic thrust bearing 50. A horizontal oil/fluid gallery 12 through the scroll compressor crankshaft 14 allows lubricating fluid/oil 54 to be supplied to the second/subsequent stage orbiting scroll radial bearing 46.

According to one embodiment, FIG. 1 also shows the lubricating fluid/oil 54 is supplied from the feed cavity 62, which may be e.g. a clearance volume, between the first stage end of the crankshaft 14 and the first stage orbiting scroll hub bore via the crankshaft gallery 12. It will be appreciated that in the embodiment shown, since the second stage orbiting scroll employs a hydrostatic thrust bearing 50, lubricating fluid/oil 54 is not supplied to the respective orbiting scroll radial bearing 46 through the thrust bearing 50. Attempting to lubricate the radial bearing 46 using high pressure forces to move past the hydrostatic thrust bearing 50 could likely force lubricating fluid/oil 54 through the radial bearing 46 since orbiting scroll radial bearings do not need lubricating fluid/oil feed pressures that are significantly above suction pressure (e.g., about 200 psid). It will be appreciated, that such journal bearings, e.g. radial orbital bearings as in this application, do not typically need oil to be supplied at significantly elevated differential pressures in order to work reliably. Supplying oil to such journal bearings at high differential pressures can risk pushing excessive amounts of oil through the bearings and may cause extra efficiency losses in the bearings & compressor.

The embodiments described herein advantageously provide a double-ended scroll compressor structure 10 that does not require an oil pump connected to the compressor crankshaft 14. The embodiments described herein further provide a double-ended scroll compressor structure 10 in which at least one of the orbiting scroll thrust bearings 50 has a balanced piston thrust bearing design, which can substantially preclude feeding lubricating fluid/oil to the respective orbiting scroll radial bearing 46 via the thrust bearing 50. The embodiments described herein further provide a double-ended scroll compressor structure 10 that provides an inexpensive technique to supply lubricating fluid/oil to one orbiting scroll radial bearing 46 from one or more oil passages (e.g. 56) and oil feed cavity (e.g. 62) of a different orbiting scroll radial bearing 44. Further, the end clearance at the first stage end of the crankshaft 14 may be open to the orbiting scroll radial bearing clearance, which can act as a vent for refrigerant outgassed from the lubricant/oil mixture due to heating from the scroll set's compression pockets.

Figure 2A:
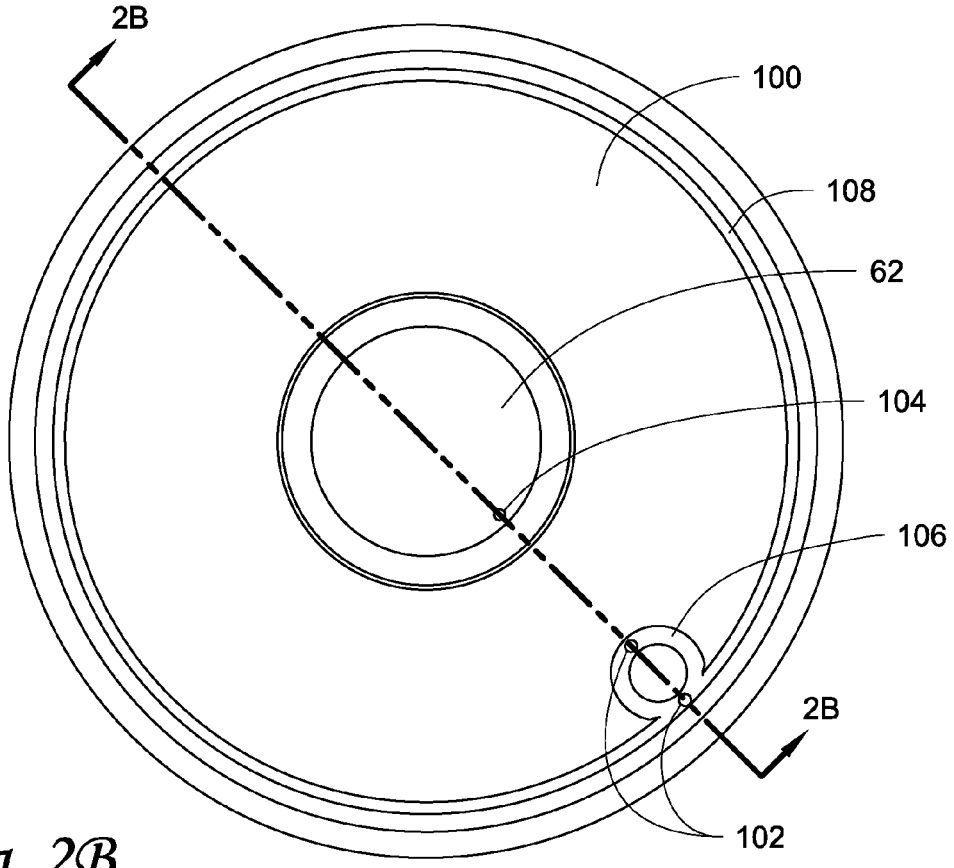
FIGS. 2A and 2B show an embodiment of a lubrication configuration through an orbiting scroll.
Figure 2B:
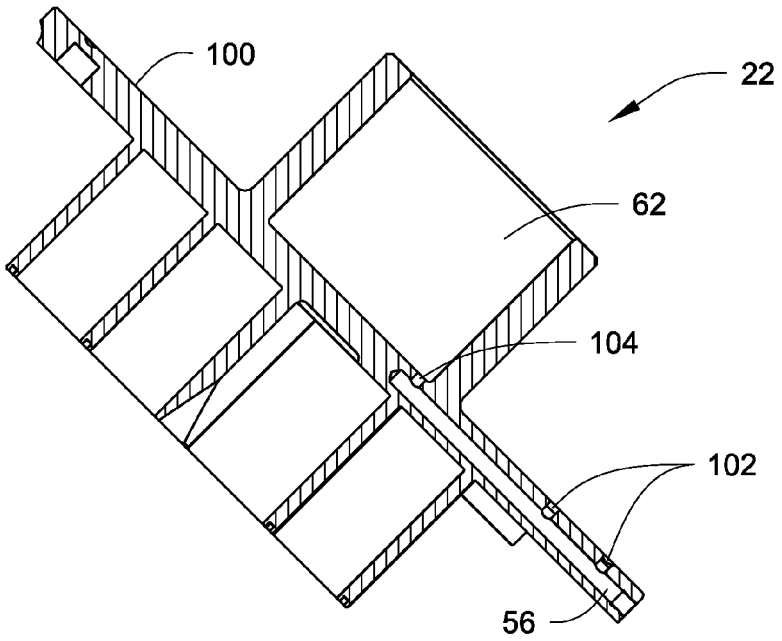
Figure 3:
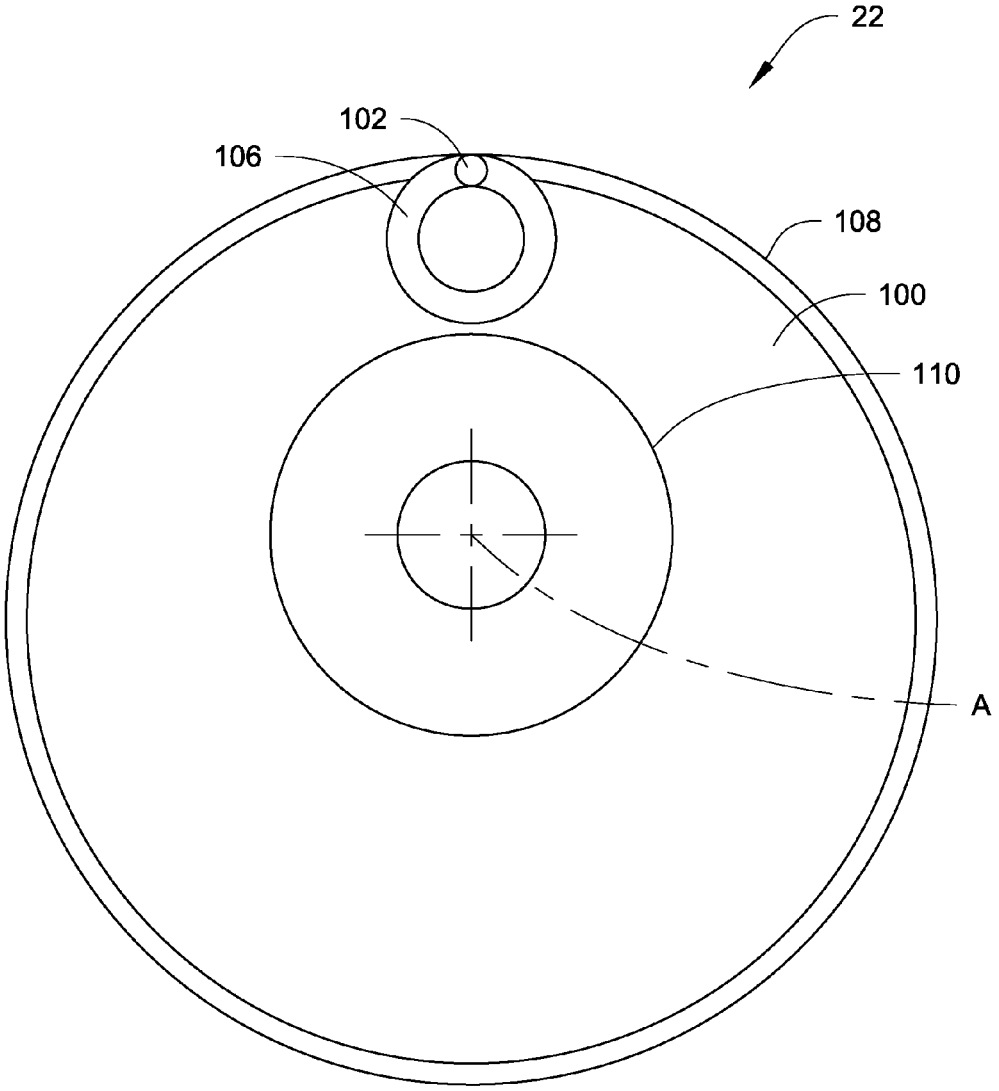
FIG. 3 shows another embodiment of a lubrication configuration through an orbiting scroll.

FIGS. 2A, 2B, and 3 show details of an additional mechanism to feed lubricating fluid, e.g. oil, to the orbiting scroll thrust bearing and radial bearing on the first-stage end of the compressor, such as the thrust bearing 48 and radial orbital bearing 44 of first stage scroll 16 shown in FIG. 1. For example, in the embodiment of FIG. 1, oil may not start by getting pumped through the crankshaft 14, so there may be a need to get oil from the high-pressure oil sump, e.g. 52, to the bearings, e.g. 44, 48 of the first stage.

In some embodiments, such a mechanism as may be implemented by either of FIGS. 2A, 2B, and 3, can generally involve an axial supply passage(s) configuration in the thrust surface of the main bearing housing (e.g. defined by diameter 110), which may communicate with one or more lubrication grooves, such as for example relatively smaller diameter lubrication grooves (e.g. groove 106 in FIG. 3) on the thrust surface of the orbiting scroll (e.g. thrust surface 100 which may be on, e.g. orbiting scroll 22 in FIG. 1).

For example, the small diameter lubrication groove(s) can communicate with a relatively larger diameter groove in the orbiting scroll thrust surface (e.g. groove 108 in FIG. 3), which distributes oil around the thrust bearing. Further, the small diameter lubrication groove can also communicate with a radial opening through the orbiting scroll base (e.g. 56 in FIGS. 1 and 2B). This radial opening can transport oil from the smaller lubrication groove to the orbiting scroll's radial bearing. Once this opening is present, such as by drilling, the outer end may be plugged as needed.

FIGS. 2A and 2B show the orbiting scroll 22 thrust surface 100, which exhibits grooves 106, 108 and oil passages 102 and 104 to lubricate the thrust bearing and the radial orbital bearing, such as via the oil passage 56 and oil cavity 62 shown in FIG. 1. The oil passages 102 are shown in fluid communication with the smaller diameter oil groove 106, which is shown in fluid communication with the larger diameter oil groove 108. The oil passage 104 is shown in fluid communication with the oil cavity 62. As shown in the section view 2B, passage 104 fluidly communicates with the radial bearing cavity 62.

FIG. 3 illustrates another view of the thrust bearing lubrication configuration, where the smaller and larger diameter oil grooves 106, 108 of the orbiting scroll thrust surface 100 are shown, along with the inner diameter of the main bearing housing thrust surface 110 relative to a centerline A of the compressor. Axial oil supply passage 102 is also shown through the housing thrust surface 100.

With further reference to FIG. 1 and in conjunction with the above discussion of the oil passages shown in FIGS. 2A, 2B, and 3, the scroll compressor orbiting scroll bearing lubrication system can also include one or more oil passages to deliver oil from a source such as the sump 52 to the hydrodynamic thrust bearing, e.g. 48. The oil passage can be through a fixed part of the compressor such as for example the bearing housing, such as through the thrust surface of the main bearing housing (see 110). Through the oil passage(s) the first radial orbital bearing and orbiting scroll hydrodynamic thrust bearing can receive lubricating fluid from the lubricating fluid sump, e.g. 52, via the oil passage(s) in the bearing housing and the oil passages in the first orbiting scroll baseplate, e.g. 102, 104.

One example of this is shown in FIG. 1, where oil passage 116 is located through a fixed part 112, which may be the main bearing housing or other non-moving part of the compressor, and which helps to transport oil from the lubricating fluid sump 52 to the orbiting scroll thrust bearing 48. In one embodiment for example, oil is supplied from the oil sump 52, through the passage 116 of the fixed part 112 to the external grooves, e.g. groove 106 and 108, in the orbiting scroll's thrust surface 100. The grooves, e.g. 106 and 108, which may be in fluid communication with each other (see e.g. FIGS. 2A and 3), in the orbiting scroll thrust surface 100 can distribute oil around the thrust surface 100 for example throughout the thrust bearing.

The passages 102, 104 help transport oil to the orbiting scroll radial bearing. For example, passages 102 are in fluid communication with passage 56 which delivers lubricating fluid to passage 104 and to the cavity 62.

It will be appreciated that the location of the passage 116 of the fixed part 112, e.g. main bearing housing, is not meant to be limiting. It will be appreciated that an opening or passage may be fixed but located in any manner that is in fluid communication with the groove(s), either or both of grooves 106, 108 so as to allow for the orbiting scroll thrust bearing 48 to be lubricated. It will also be appreciated that the pressure supplied to bearing 48 can be at a relatively lower pressure than that of the orbiting scroll thrust bearing 50, such as when a hydrodynamic bearing is employed for bearing 48.

Figure 4:
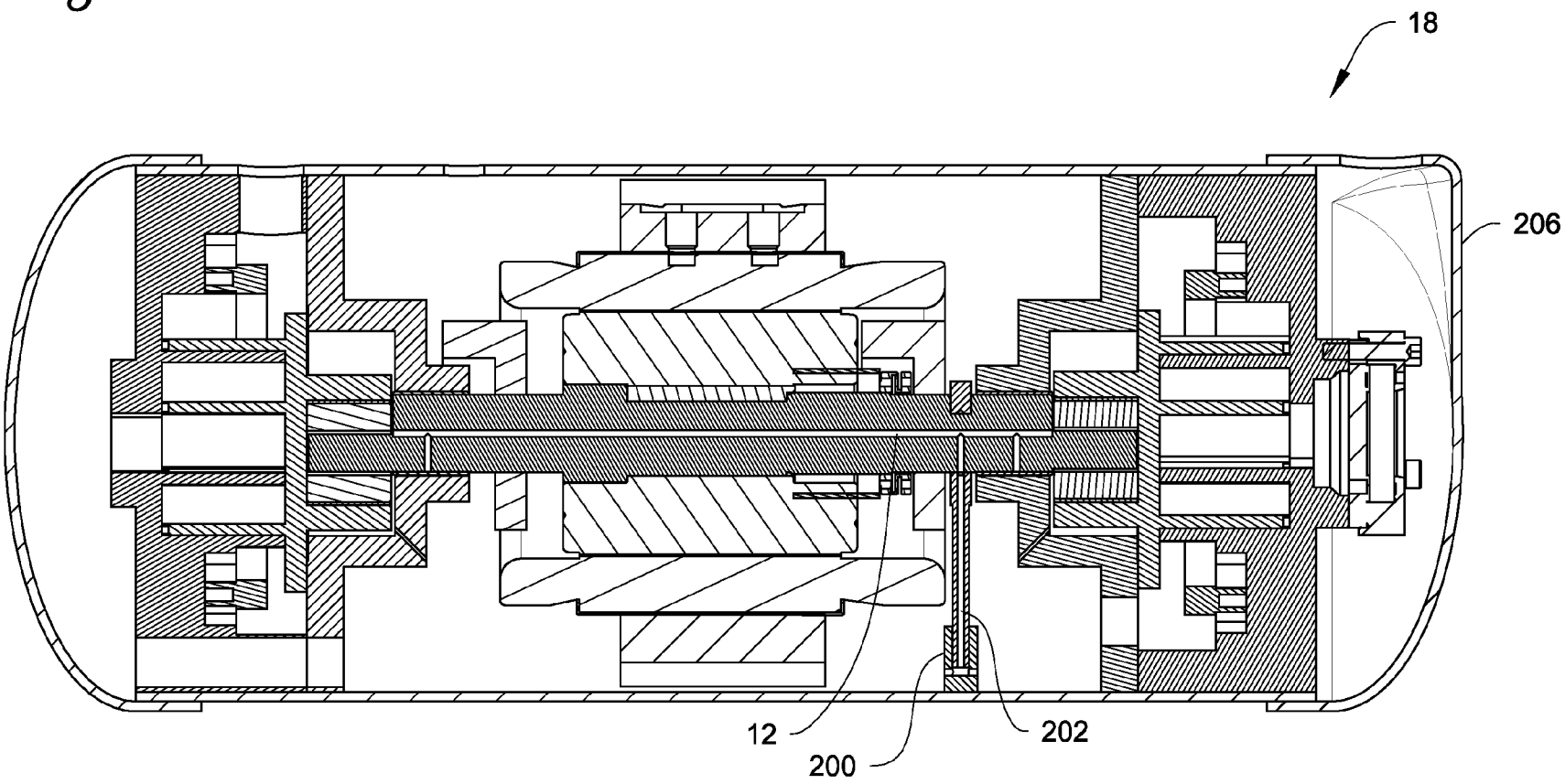
FIG. 4 shows another embodiment of a lubrication configuration through an oil gallery.

FIG. 4 shows another embodiment of lubrication through the gallery, e.g. 12 in FIG. 1 to the second stage 18 in FIG. 1. As shown, a pump 200 may feed the radial orbital bearings, e.g. radial orbital bearings 44, 46 through passage 202 that fluidly communicates the pump 200 with the gallery 12. In some embodiments, the pump 200 can be internal to the overall compressor housing 206, but could be disposed outside the compressor housing 206. FIG. 4 shows the passage 202 to the gallery 12. It will be appreciated that, when an internal oil pump supplies oil to the oil gallery 12, a high pressure sump (e.g. 52) may not be employed to supply oil to the radial orbital bearings, e.g. 44, 46. It will further be appreciated that, when an internal oil pump or other oil supply source is used to access the gallery 12, both radial orbital bearings, e.g. 44, 46, may be supplied as well as the first stage thrust bearing, e.g. 48, but where the direction of flow arrows would be changed, e.g. flowing from the source, such as the pump 200 and passage 202.

It will be appreciated that any of aspects 1 and 2 may be combined with any of aspects 3 to 22, and any of aspects 3 to 6 may be combined with any of aspects 7 to 22, and any of aspects 7 to 14 may be combined with any of aspects 15 to 22.

Aspect 1. A scroll compressor orbiting scroll bearing lubrication system, comprising: a lubricating fluid sump storing a lubricating fluid pressurized higher than the scroll compressor suction pressure; a compressor crankshaft comprising: a first eccentric drive pin extending from a first end of the crankshaft, wherein the first drive pin is rotatably disposed at least partially within a first radial orbital bearing and configured to engage a first orbiting scroll comprising a baseplate and a spiral wrap element extending from the baseplate, and further comprising one or more oil passages in the baseplate; a second eccentric drive pin extending from a second end of the crankshaft, wherein the second drive pin is rotatably disposed at least partially within a second radial orbital bearing and configured to engage a second orbiting scroll; an orbiting scroll hydrodynamic thrust bearing associated with the first orbiting scroll, wherein the first radial orbital bearing and the orbiting scroll hydrodynamic thrust bearing are configured to receive lubricating fluid from the lubricating fluid sump via the one or more oil passages in the first orbiting scroll baseplate;

Aspect 2. The scroll compressor orbiting scroll bearing lubrication system according to aspect 1, further comprising a bearing housing containing one or more oil supply passages, wherein the first radial orbital bearing and orbiting scroll hydrodynamic thrust bearing are configured to receive lubricating fluid from the lubricating fluid sump via the oil passage in the bearing housing and in the one or more oil passages in the first orbiting scroll baseplate.

Aspect 3. A scroll compressor orbiting scroll bearing lubrication system, comprising: a lubricating fluid sump storing a lubricating fluid pressurized substantially higher than the scroll compressor suction pressure; a compressor crankshaft comprising: a first eccentric drive pin extending from a first end of the crankshaft, wherein the first drive pin is rotatably disposed at least partially within a first radial orbital bearing and configured to engage a first orbiting scroll comprising a baseplate and a spiral wrap element extending from the baseplate, and further comprising one or more oil passages in the baseplate; a second eccentric drive pin extending from a second end of the crankshaft, wherein the second drive pin is rotatably disposed at least partially within a second radial orbital bearing and configured to engage a second orbiting scroll; an orbiting scroll hydrodynamic thrust bearing associated with the first orbiting scroll; and an orbiting scroll hydrostatic thrust bearing associated with the second orbiting scroll; wherein the compressor crankshaft further comprises a lubricating fluid gallery extending axially through the crankshaft between the first orbiting scroll and the second orbiting scroll such that lubricating fluid is supplied to the second radial orbital bearing via the one or more oil passages in the first orbiting scroll baseplate and the lubricating fluid gallery.

Aspect 4. The scroll compressor orbiting scroll bearing lubrication system according to aspect 3, further comprising a clearance volume between the first end of the crankshaft and a hub bore associated with the first orbiting scroll, wherein the clearance volume stores lubricating fluid from the lubricating fluid sump such that the lubricating fluid supplied to the second radial orbital bearing is further supplied via the clearance volume.

Aspect 5. The scroll compressor orbiting scroll bearing lubrication system according to aspect 3 or 4, wherein the stored lubricating fluid is pressurized at or above about 200 psid relative to the scroll compressor suction pressure.

Aspect 6. The scroll compressor orbiting scroll bearing lubrication system according to any of aspect 3 to 5, wherein lubricating fluid is supplied to the first radial orbital bearing at no more than about 70 psid relative to the scroll compressor suction pressure.

Aspect 7. A scroll compressor orbiting scroll bearing lubrication system, comprising: a scroll compressor crankshaft comprising a lubricating fluid gallery extending therethrough: a first stage orbiting scroll driven via a first end of the scroll compressor crankshaft rotatably disposed at least partially within a first orbiting scroll radial bearing; a second stage orbiting scroll driven via a second end of the scroll compressor crankshaft rotatably disposed at least partially within a second orbiting scroll radial bearing; an orbiting scroll hydrodynamic thrust bearing associated with the first stage orbiting scroll; and an orbiting scroll hydrostatic thrust bearing associated with the second stage orbiting scroll; wherein lubricating fluid is supplied to the second orbiting scroll radial bearing via the lubricating fluid gallery.

Aspect 8. The scroll compressor orbiting scroll bearing lubrication system according to aspect 7, further comprising a lubricating fluid sump storing a lubricating fluid pressurized substantially higher than the scroll compressor suction pressure, and configured to supply the lubricating fluid to one or more of the first orbiting scroll thrust bearing, the first orbiting scroll radial bearing, and the second orbiting scroll radial bearing.

Aspect 9. The scroll compressor orbiting scroll bearing lubrication system according to aspect 7 or 8, wherein the first stage orbiting scroll comprises baseplate and a spiral wrap element extending from the baseplate, and further comprises one or more oil passages extending through the baseplate, such that lubricating fluid is supplied to the first orbiting scroll radial bearing via the one or more oil passages.

Aspect 10. The scroll compressor orbiting scroll bearing lubrication system according to aspect 9, wherein lubricating fluid is further supplied to the second orbiting scroll radial bearing via the one or more oil passages.

Aspect 11. The scroll compressor orbiting scroll bearing lubrication system according to any of aspects 8 to 10, further comprising a clearance volume between the first end of the crankshaft and a hub bore associated with the first orbiting scroll, wherein the clearance volume stores lubricating fluid from the lubricating fluid sump such that the lubricating fluid supplied to the second orbiting scroll radial bearing is further supplied via the clearance volume.

Aspect 12. The scroll compressor orbiting scroll bearing lubrication system according to any of aspects 7 to 11, wherein lubricating fluid is supplied to the first orbiting scroll radial bearing at no more than about 70 psid relative to the scroll compressor suction pressure.

Aspect 13. The scroll compressor orbiting scroll bearing lubrication system according to any of aspects 8 to 12, wherein the stored lubricating fluid is pressurized at or above about 200 psid relative to the scroll compressor suction pressure.

Aspect 14. The scroll compressor orbiting scroll bearing lubrication system according to any of aspects 8 to 13, further comprising an oil passage to supply lubricating fluid to the orbiting scroll hydrostatic thrust bearing associated with the second stage orbiting scroll at a pressure different than a pressure of the lubricating fluid supplied to one or more of the first orbiting scroll thrust bearing, the first orbiting scroll radial bearing, and the second orbiting scroll radial bearing.

Aspect 15. A scroll compressor orbiting scroll bearing lubrication system, comprising: a scroll compressor crankshaft comprising a lubricating fluid gallery extending therethrough between a first stage orbiting scroll and a second stage orbiting scroll; a first stage orbiting scroll radial bearing; a first stage orbiting scroll hydrodynamic thrust bearing; a second stage orbiting scroll radial bearing; and a second stage orbiting scroll hydrostatic thrust bearing; wherein lubricating fluid is supplied to the second stage orbiting scroll radial bearing via the lubricating fluid gallery.

Aspect 16. The scroll compressor orbiting scroll bearing lubrication system according to aspect 15, further comprising a lubricating fluid sump storing a lubricating fluid pressurized substantially higher than the scroll compressor suction pressure, and configured to supply the lubricating fluid to one or more of the first orbiting scroll thrust bearing, the first orbiting scroll radial bearing, and the second orbiting scroll radial bearing.

Aspect 17. The scroll compressor orbiting scroll bearing lubrication system according to aspect 15 or 16, wherein the first stage orbiting scroll comprises a baseplate and a spiral wrap element extending from the baseplate, and further comprises one or more oil passages extending through the baseplate, such that lubricating fluid is supplied to the first stage orbiting scroll radial bearing via the one or more oil passages.

Aspect 18. The scroll compressor orbiting scroll bearing lubrication system according to aspect 17, wherein lubricating fluid is further supplied to the second stage orbiting scroll radial bearing via the one or more oil passages.

Aspect 19. The scroll compressor orbiting scroll bearing lubrication system according to any of aspects 16 to 18, further comprising a clearance volume between the first stage end of the crankshaft and a hub bore associated with the first stage orbiting scroll, wherein the clearance volume stores lubricating fluid from the lubricating fluid sump such that the lubricating fluid supplied to the second orbiting scroll radial bearing is further supplied via the clearance volume.

Aspect 20. The scroll compressor orbiting scroll bearing lubrication system according to any of aspects 15 to 19, wherein lubricating fluid is supplied to the first stage orbiting scroll radial bearing at no more than about 70 psid relative to the scroll compressor suction pressure.

Aspect 21. The scroll compressor orbiting scroll bearing lubrication system according to any of aspects 16 to 20, wherein the stored lubricating fluid is pressurized at or above about 200 psid relative to the scroll compressor suction pressure.

Aspect 22. The scroll compressor orbiting scroll bearing lubrication system according to any of aspects 16 to 21, further comprising an oil passage to supply lubricating fluid to the orbiting scroll hydrostatic thrust bearing associated with the second stage orbiting scroll at a pressure different than a pressure of the lubricating fluid supplied to one or more of the first orbiting scroll thrust bearing, the first orbiting scroll radial bearing, and the second orbiting scroll radial bearing.

While the embodiments have been described in terms of various specific embodiments, those skilled in the art will recognize that the embodiments can be practiced with modification within the spirit and scope of the claims.

What is claimed is:

1. A scroll compressor orbiting scroll bearing lubrication system, comprising:

a lubricating fluid sump;

a compressor crankshaft comprising:

a first eccentric drive pin extending from a first end of the crankshaft, wherein the first drive pin is rotatably disposed at least partially within a first radial orbital bearing and configured to engage a first orbiting scroll comprising a baseplate, the baseplate having a spiral wrap element extending from a first side of the baseplate and having a sleeve extending from a second side of the baseplate opposite to the first side, the sleeve defining a cavity, and further comprising one or more oil passages in the baseplate;

a second eccentric drive pin extending from a second end of the crankshaft, wherein the second drive pin is rotatably disposed at least partially within a second radial orbital bearing and configured to engage a second orbiting scroll;

an orbiting scroll hydrodynamic thrust bearing associated with the first orbiting scroll, wherein the first radial orbital bearing and the orbiting scroll hydrodynamic thrust bearing are configured to receive lubricating fluid from the lubricating fluid sump via the one or more oil passages in the baseplate;

wherein the one or more oil passages include at least one first oil passage that extends through the baseplate to the second side of the baseplate to feed lubricating fluid into the cavity defined by the sleeve of the baseplate to lubricate the first radial orbital bearing; and the one or more oil passages include at least one second oil passage that extends through the baseplate to the second side of the baseplate and opens to a location outside of the cavity defined by the sleeve so as to feed lubricating fluid to the second side of the baseplate to lubricate the orbiting scroll hydrodynamic thrust bearing.

2. The scroll compressor orbiting scroll bearing lubrication system according to claim 1, further comprising a bearing housing containing one or more oil supply passages, wherein the first radial orbital bearing and orbiting scroll hydrodynamic thrust bearing are configured to receive lubricating fluid from the lubricating fluid sump via the one or more oil supply passages of the bearing housing and from the one or more oil passages in the baseplate.

3. A scroll compressor orbiting scroll bearing lubrication system, comprising:

a lubricating fluid sump;

a compressor crankshaft comprising:

a first eccentric drive pin extending from a first end of the crankshaft, wherein the first drive pin is rotatably disposed at least partially within a first radial orbital bearing and configured to engage a first orbiting scroll comprising a baseplate and a spiral wrap element extending from the baseplate, and further comprising one or more oil passages in the baseplate;

a second eccentric drive pin extending from a second end of the crankshaft, wherein the second drive pin is rotatably disposed at least partially within a second radial orbital bearing and configured to engage a second orbiting scroll;

an orbiting scroll hydrodynamic thrust bearing associated with the first orbiting scroll; and an orbiting scroll hydrostatic thrust bearing associated with the second orbiting scroll;

wherein the compressor crankshaft further comprises a lubricating fluid gallery extending axially through the crankshaft between the first orbiting scroll and the second orbiting scroll such that lubricating fluid is supplied to the second radial orbital bearing via the one or more oil passages in the first orbiting scroll baseplate and the lubricating fluid gallery.

4. The scroll compressor orbiting scroll bearing lubrication system according to claim 3, further comprising a clearance volume between the first end of the crankshaft and a hub bore associated with the first orbiting scroll, wherein the clearance volume stores lubricating fluid from the lubricating fluid sump such that the lubricating fluid supplied to the second radial orbital bearing is further supplied via the clearance volume.

5. The scroll compressor orbiting scroll bearing lubrication system according to claim 3, wherein the stored lubricating fluid is pressurized at 200 psid relative to a suction pressure of the scroll compressor.

6. The scroll compressor orbiting scroll bearing lubrication system according to claim 3, wherein lubricating fluid is supplied to the first radial orbital bearing at 70 psid relative to a suction pressure of the scroll compressor.

7. A scroll compressor orbiting scroll bearing lubrication system, comprising:

a scroll compressor crankshaft comprising a lubricating fluid gallery extending therethrough:

a first stage orbiting scroll driven via a first end of the scroll compressor crankshaft rotatably disposed at least partially within a first orbiting scroll radial bearing;

a second stage orbiting scroll driven via a second end of the scroll compressor crankshaft rotatably disposed at least partially within a second orbiting scroll radial bearing;

an orbiting scroll hydrodynamic thrust bearing associated with the first stage orbiting scroll; and an orbiting scroll hydrostatic thrust bearing associated with the second stage orbiting scroll;

wherein the first stage orbiting scroll comprises a baseplate and a spiral wrap element extending from the baseplate, and further comprises one or more oil passages extending through the baseplate, such that lubricating fluid is supplied to the first orbiting scroll radial bearing via the one or more oil passages, and wherein lubricating fluid is supplied to the second orbiting scroll radial bearing via the lubricating fluid gallery.

8. The scroll compressor orbiting scroll bearing lubrication system according to claim 7, further comprising a lubricating fluid sump configured to supply lubricating fluid to one or more of the orbiting scroll hydrodynamic thrust bearing associated with the first stage orbiting scroll, the first orbiting scroll radial bearing, and the second orbiting scroll radial bearing.

9. The scroll compressor orbiting scroll bearing lubrication system according to claim 8, further comprising a clearance volume between the first end of the crankshaft and a hub bore associated with the first orbiting scroll, wherein the clearance volume stores lubricating fluid from the lubricating fluid sump such that the lubricating fluid supplied to the second orbiting scroll radial bearing is further supplied via the clearance volume.

10. The scroll compressor orbiting scroll bearing lubrication system according to claim 8, wherein the stored lubricating fluid is pressurized at 200 psid relative to a suction pressure of the scroll compressor.

11. The scroll compressor orbiting scroll bearing lubrication system according to claim 8, further comprising an oil passage to supply lubricating fluid to the orbiting scroll hydrostatic thrust bearing associated with the second stage orbiting scroll at a pressure different than a pressure of the lubricating fluid supplied to one or more of the orbiting scroll hydrodynamic thrust bearing associated with the first stage orbiting scroll, the first orbiting scroll radial bearing, and the second orbiting scroll radial bearing.

12. The scroll compressor orbiting scroll bearing lubrication system according to claim 7, wherein lubricating fluid is further supplied to the second orbiting scroll radial bearing via the one or more oil passages.

13. The scroll compressor orbiting scroll bearing lubrication system according to claim 7, wherein lubricating fluid is supplied to the first orbiting scroll radial bearing at no more than 70 psid relative to a suction pressure of the scroll compressor.

14. A scroll compressor orbiting scroll bearing lubrication system, comprising:

a scroll compressor crankshaft comprising a lubricating fluid gallery extending therethrough between a first stage orbiting scroll and a second stage orbiting scroll;

a first stage orbiting scroll radial bearing;

a first stage orbiting scroll hydrodynamic thrust bearing;

a second stage orbiting scroll radial bearing; and a second stage orbiting scroll hydrostatic thrust bearing;

wherein the first stage orbiting scroll comprises a baseplate and a spiral wrap element extending from the baseplate, and further comprises one or more oil passages extending through the baseplate, such that lubricating fluid is supplied to the first stage orbiting scroll radial bearing via the one or more oil passages; and wherein lubricating fluid is supplied to the second stage orbiting scroll radial bearing via the lubricating fluid gallery.

15. The scroll compressor orbiting scroll bearing lubrication system according to claim 14, further comprising a lubricating fluid sump configured to supply lubricating fluid to one or more of the first stage orbiting scroll hydrodynamic thrust bearing, the first stage orbiting scroll radial bearing, and the second stage orbiting scroll radial bearing.

16. The scroll compressor orbiting scroll bearing lubrication system according to claim 15, further comprising a clearance volume between the first stage end of the crankshaft and a hub bore associated with the first stage orbiting scroll, wherein the clearance volume stores lubricating fluid from the lubricating fluid sump such that the lubricating fluid supplied to the second stage orbiting scroll radial bearing is further supplied via the clearance volume.

17. The scroll compressor orbiting scroll bearing lubrication system according to claim 15, wherein the stored lubricating fluid is pressurized at 200 psid relative to a suction pressure of the scroll compressor.

18. The scroll compressor orbiting scroll bearing lubrication system according to claim 15, further comprising an oil passage to supply lubricating fluid to the second stage orbiting scroll hydrostatic thrust bearing at a pressure different than a pressure of the lubricating fluid supplied to one or more of the first stage orbiting scroll hydrodynamic thrust bearing, the first stage orbiting scroll radial bearing, and the second stage orbiting scroll radial bearing.

19. The scroll compressor orbiting scroll bearing lubrication system according to claim 14, wherein lubricating fluid is further supplied to the second stage orbiting scroll radial bearing via the one or more oil passages.

20. The scroll compressor orbiting scroll bearing lubrication system according to claim 14, wherein lubricating fluid is supplied to the first stage orbiting scroll radial bearing at no more than 70 psid relative to a suction pressure of the scroll compressor.

* * * * *